United States Patent [19]

Cosentino et al.

[11] 4,363,609

[45] Dec. 14, 1982

[54] BLOOD PUMP SYSTEM

[75] Inventors: Louis C. Cosentino, Wayzata; Bill H. Niemi, Brooklyn Park; John P. Silbernagel, Spring Lake Park; Jamshed R. Cooper, Golden Valley, all of Minn.

[73] Assignee: Renal Systems, Inc., Minneapolis, Minn.

[21] Appl. No.: 114,717

[22] Filed: Jan. 23, 1980

Related U.S. Application Data

[62] Division of Ser. No. 849,338, Nov. 7, 1977, Pat. No. 4,221,543.

[51] Int. Cl.[3] ..... F04B 43/12

[52] U.S. Cl. ..... 417/477

[58] Field of Search ..... 417/477, 476

[56] References Cited

U.S. PATENT DOCUMENTS

| | | | |
|---|---|---|---|
| 2,935,028 | 5/1960 | Ferrari et al. | 417/477 X |
| 3,192,863 | 7/1965 | Vadot | 417/477 |
| 3,787,148 | 1/1974 | Kopf | 417/477 |
| 3,885,894 | 5/1975 | Sikes | 417/477 |
| 3,918,854 | 11/1975 | Catarious et al. | 417/477 |
| 3,963,023 | 6/1976 | Hankinson | 417/477 |

*Primary Examiner*—Richard E. Gluck

*Attorney, Agent, or Firm*—Schroeder, Siegfried, Vidas, Steffey & Arrett

[57] ABSTRACT

A blood pump system in which a roller pump is provided for pumping blood through a flexible tube. A low voltage D.C. motor is provided having an output shaft. An electrical control circuit is connected to the motor for applying the necessary voltage to drive the motor at a predetermined speed. Gearing means are provided connecting the motor's output shaft to drive the roller pump. Means are optically coupled to the motor for controlling the speed of the motor. Means are connected to the optically coupled means to determine the blood flow rate being pumped though the tube by the pump. Means are provided which display a digital readout of the flow rate. The roller pump is provided with an arcuate bearing surface, which carries the flexible tube, the bearing surface defining an arc of approximately 168°. Lead ramps extend from each end of the bearing surface and are substantially tangent to the end of the surface from which the respective ramp extends. Means are provided for allowing a variable rate of independently adjusting the radial deflection of each of the rollers of the roller pump. The system is also provided with isolation means for reducing leakage current and thus lowering the potential shock hazard to the patient from A.C. line voltage. Motor runaway and overspeed protection are also provided.

6 Claims, 5 Drawing Figures

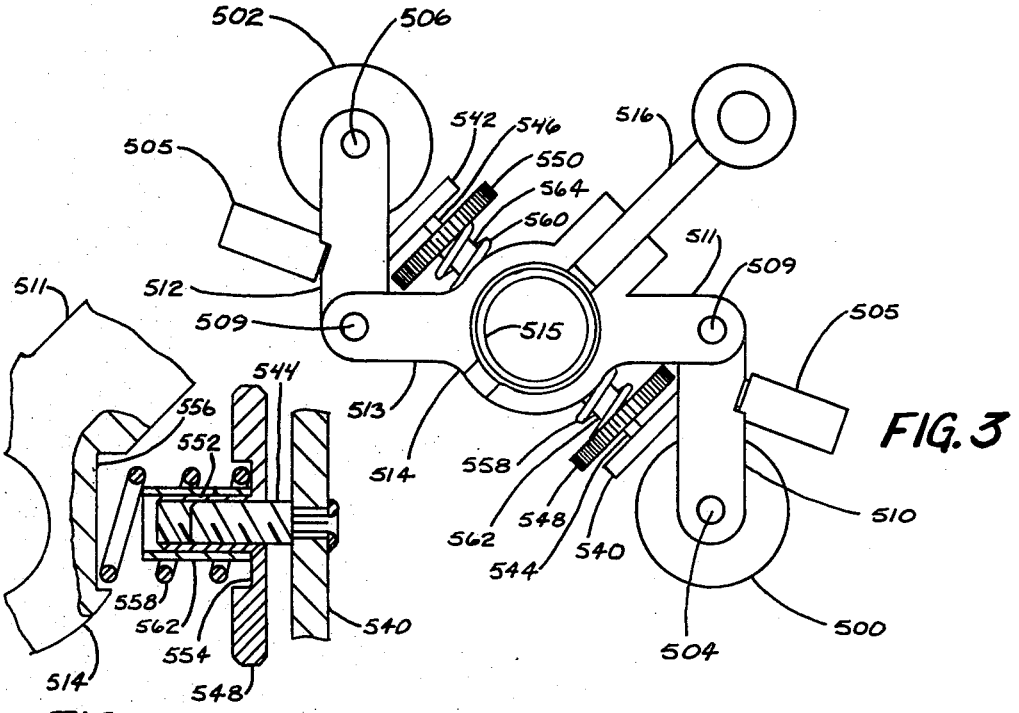
FIG. 3
FIG. 5
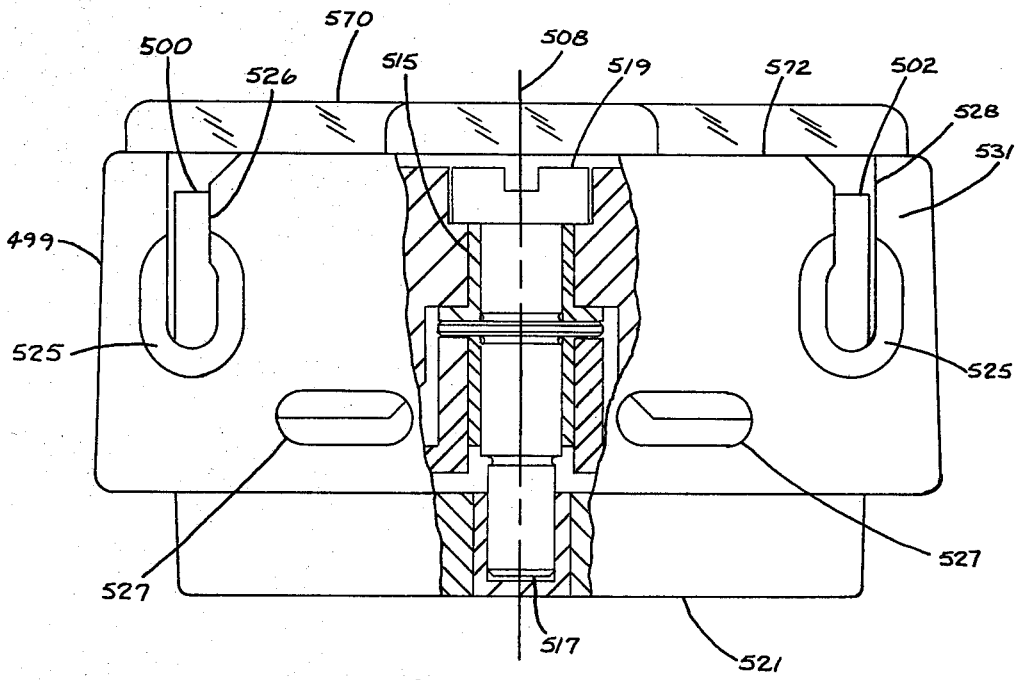
FIG. 2

BLOOD PUMP SYSTEM

This is a division of application Ser. No. 849,338, filed Nov. 7, 1977 now U.S. Pat. No. 4,221,543 which is hereby incorporated by reference.

BACKGROUND OF INVENTION

This invention relates to a blood pump system including a blood pump control system for driving a roller blood pump of the type used in hemodialysis systems.

Prior art blood pump systems used in hemodialysis systems have a number of operating disadvantages which it is the purpose of the present invention to overcome. One of the most important features of a blood pump system used in hemodialysis is precise regulation of the speed of the motor driving the blood pump. This is important because the precise regulation of blood flow can be critical for the patient from a physiological standpoint. Prior art systems do not provide as precise a regulation as desired. Along with this flow rate regulation it is necessary for the system's operator to know the exact flow rate. Systems currently available do not provide a direct digital readout of flow rate but merely provide an analog relative scale which the operator must correlate to blood flow rate. In order to protect against motor overload prior art systems use electromechanical circuit breakers to disable the motor. Such circuit breakers are relatively slow operating and are not particularly precise in terms of the level at which switching occurs. Another problem with many prior systems is that they use 110 volt motors which operate directly off line voltage. Such systems have a relatively high leakage current which creates a much greater shock hazard potential for the patient. Also many prior art systems do not utilize an optimal design configuration which allows for use of a much smaller motor by reducing the peak torque required for driving the pump. U.S. Pat. No. 3,787,148 is an example of a prior art blood pump which does not utilize the optimal design. This reference shows a pump having an arcuate bearing surface defining an arc of 177° and having lead ramps which diverge from the ends of the arcuate bearing surface by 10°. Such configuration does not allow for the optimal peak torque reduction for rotation of the rollers. In addition the 10° lead ramp divergence creates a somewhat abrupt change in the cross-sectional bore of the flexible tube through which the blood is pumped as the rollers approach and recede from the point of occlusion of the tube. Such change is also not desirable from the physiological viewpoint of the patient. Also prior art systems do not allow for a variable rate of independent adjustability of each of the rollers used in the roller pump or adjustment mechanism for adjusting the rollers which is located radially with respect to the main axis of rotation of the rotator head assembly.

SUMMARY OF INVENTION

The blood pump system of the present invention provides a roller pump for pumping blood through a flexible tube.

In the roller blood pump of the present invention there is provided an arcuate bearing surface defining a arc of approximately 168° which is adapted to carry the flexible tube through which the blood is pumped. A pair of 180° spaced-apart pivotally-mounted rollers which travel in a circular path concentric with the bearing surface are provided to occlude the tube thereby pumping blood therethrough. Means are provided for moving the rollers around the circular path. Lead ramps extend from each end of the bearing surface, each of the ramps extending substantially tangent to the end of the surface from which the respective ramp extends whereby the 168° arc and the tangent ramps provide the optimal torque peak reduction for the motor to drive the pump and the optimal graduated change in cross-section of the bore of the tube as each of the rollers approach and recede from the points of occlusion of the tube. Means located radially with respect to the main axis of rotation of the rotator head assembly are also provided for variable rate of independently adjusting the extent to which each of the rollers occludes the tube.

BRIEF DESCRIPTION OF THE DRAWINGS

FIG. 2 is a side elevational view, partly in section, of the pump shown in FIG. 1 with the cover closed and the rollers in the position shown in FIG. 4 and no tube positioned in the pump;

FIG. 3 is a view of the details of the rotator head assembly of the pump of the present invention as shown in FIG. 1;

FIG. 5 is a cutaway view of the adjusting mechanism for each roller of the roller pump of the present invention as shown in FIGS. 1 and 3.

DESCRIPTION OF THE INVENTION

Figure 1:
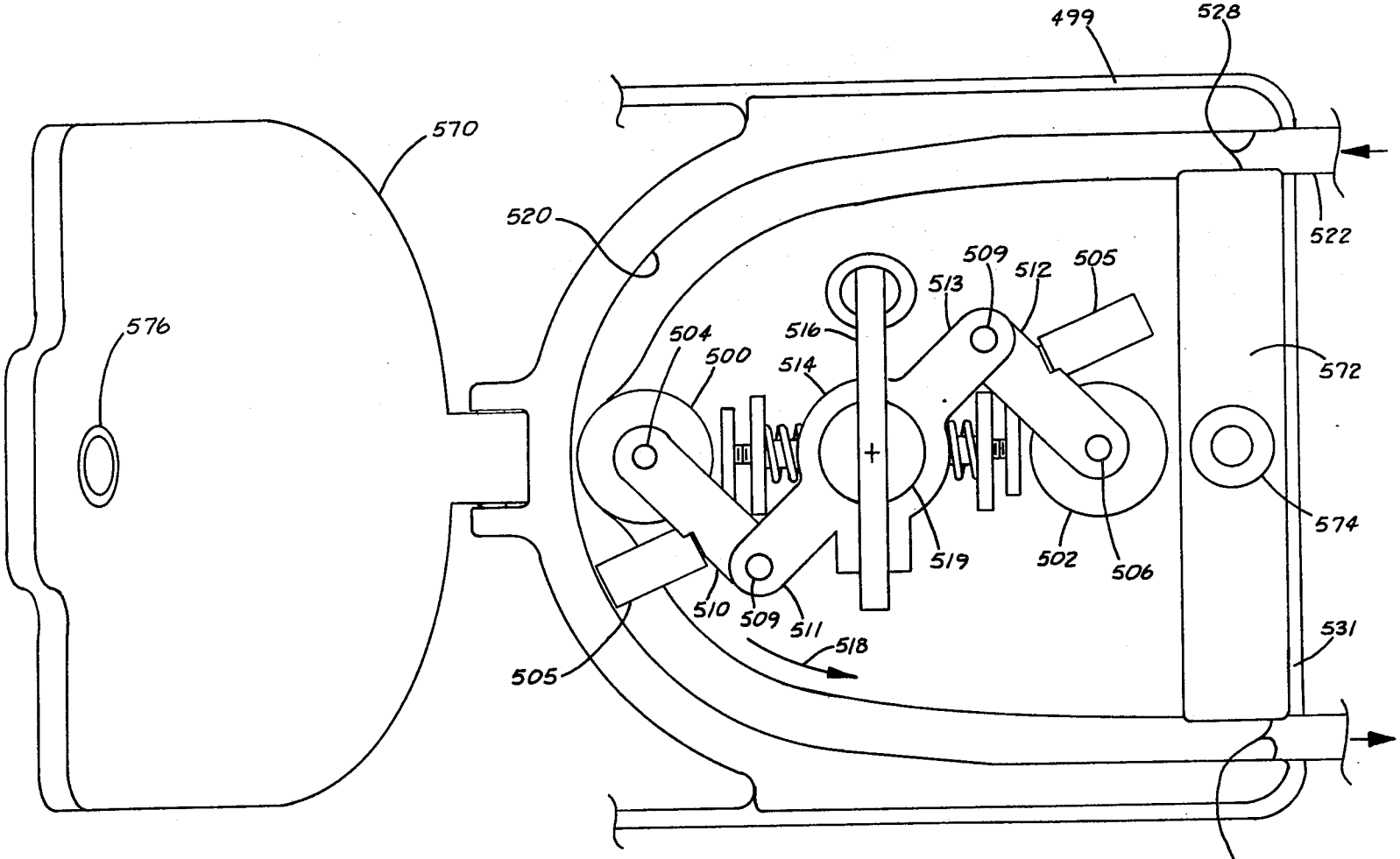
FIG. 1 is a front view of the mechanical portion of the roller pump of the present invention.

FIGS. 1–5 show details pump 5 of the present invention. FIG. 1 shows a rotator head assembly including a housing 499 having a pair of opposed rollers 500 and 502 mounted for rotation about axes defined by pins 504 and 506 which are shown perpendicular to the plane of the drawing. Rollers 500 and 502 are spaced apart 180° and are carried for rotation about axis 508 (shown in FIG. 2) on pivotally-mounted arms 510 and 512 respectively. Arms 510 and 512 are pivoted from extensions 511 and 513 respectively which are integrally formed with a rotator 514 as seen in FIGS. 1 and 3. Arms 510 and 512 pivot about pins 509. Arms 510 and 512 each have extended therefrom guide rollers 505 which are mounted on arms 510 and 512 for rotational purposes as will be explained below. Rotator 514 has a sleeve busing 515 as seen in FIGS. 2 and 3 for allowing easy manual rotation of the rotator head assembly. A handle 516 is hinged to rotator 514, which when in its open position shown in FIG. 3, may be used to manually rotate the rotator head assembly. In its closed position (FIG. 1) handle 516 is folded down in the slotted head of locking screw 519 which locks the rotator head assembly in position so that torque may be transmitted from shaft 517 to the assembly.

Rotator 514 is coupled by a shaft 517 via reduction gears to the output shaft of motor (not shown). Rotary motion to rotator 514 is transmitted from shaft 517 through a three stage gear reduction device located within the portion of the housing labeled 521. The first reduction is achieved through the mating of a steel helical pinion and a thermoplastic helical gear. The second reduction is from a steel spur pinion to a steel spur gear. The third reduction is from a steel spur pinion to a steel spur gear. This last spur gear is rigidly fixed to shaft 517. The details of these gears are not shown but are contained within the portion of the housing labeled 521.

As rotator 514 rotates about axis 508 by the rotation of shaft 517, arms 510 and 512 and rollers 500 and 502 travel around a circular path indicated by arrow 518. The axes defined by pins 504 and 506 of rollers 500 and 502 respectively move along a circular path concentric with a bearing surface 520.

A flexible tube 522 for carrying blood from a patient is provided so as to be carried by arcuate bearing surface 520. As extensions 511 and 513 and their respective arms 510 and 512 rotate around axis 508, the tube 522 is squeezed against bearing surface 520 by either of the two rollers 500 and 502, thereby rotating the roller about the axis defined by pins 504 and 506 respectively, to pump blood in and out of the tube in the direction of the arrows shown in FIG. 1. Guide rollers 505 hold tube 522 down in proper position as tube 522 is occluded by rollers 500 and 502. Guide rollers 505 are positioned radially about the axis 508. By positioning guide rollers 505 in this way possible damage to tube 522 is avoided. In prior art pumps such guide rollers do not have axes of rotation which pass through the axis of rotation of the rotator head assembly, thereby creating a greater possibility of tearing the tube as the unit rotates. Tube 522 is secured in position by frictionally fitting in slots 526 and 528 which are integrally formed of the same piece of material of which the arcuate bearing surface 520 is formed. By providing these slots it is unnecessary to provide spring-loaded clamps for holding tube 522, which clamps are subject to wear and tear and breakage. In addition, adjacent slots 526 and 528 are two cut out portions 525 which are formed in the side face 531 of the housing 499 as seen in FIG. 2. Typically the ends of tube 522 are connected to additional tubing by end caps (not shown). Cut out portions 525 serve as a means for locking the end caps in position so that when connected to tube 522, tube 522 cannot come out of slots 526 and 528. The side face 531 of housing 499 also has openings 527 which serve as clean out openings to clean any debris from the inside of the area defined by bearing surface 520.

Figure 4:
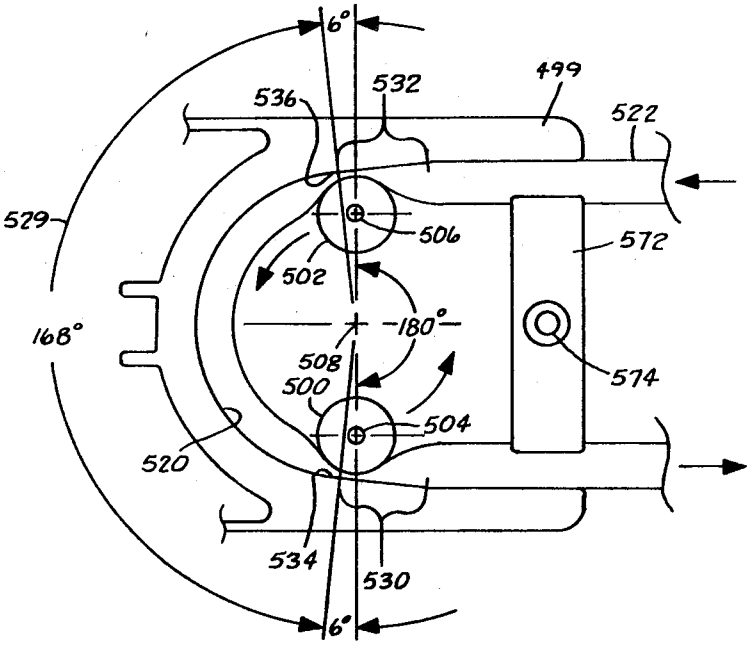
FIG. 4 is a schematic diagram showing the critical dimensions and relationships of the pump of the present invention.

FIG. 4 is a schematic top view showing roller 502 as it begins to squeeze flexible tube 522 against bearing surface 520 and roller 500 as it begins to disengage from flexible tube 522. This is the point at which roller pumps of the prior art required the peak torque to keep the pump operating smoothly. In this invention, it has been found that the optimal angular length defined by bearing surface 520 is an arc 529 of approximately 168°. This arc of 168° allows for the optimal peak reduction in torque necessary for driving the rotator head assembly. The axes defined by pins 504 and 506 of roller 500 and 502 respectively are spaced 180° apart. Coupled with this arc 529 of 168°, lead ramps 530 and 532 (shown with brackets to illustrate their length) are provided at each end of the arcuate portion of bearing surface 520, with lead ramp 530 starting at point 534 and lead ramp 532 starting at point 536. Ramp 530 is perfectly tangent to surface 520 at the exact point 534 and ramp 532 is perfectly tangent to surface 520 at the exact point 536 of the circular arc defined by surface 520. Thus there is a perfectly smooth transition from surface 520 to lead ramps 530 and 532.

The effect of lead ramps 530 and 532 is to provide for optimal disengagement of roller 500 to begin as roller 502 begins to squeeze flexible tube 522. "Disengagement" as used herein means reduction of occlusion of tube 522 by a given roller. During operation of the pump, it is necessary that flexible tube 30 be sufficiently occluded to prevent a backflow of blood through the pump. Rollers 500 and 502 in the position shown in FIG. 4 must together provide sufficient occlusion of flexible tube 522 to prevent backflow while lead ramps 530 and 532 together with arc 529 defined by surface 520 provide the optimal peak torque reduction required to drive the pump through the position shown in FIG. 4. In addition the ramps by being tangent provide the optimal graduated change in cross-section of the bore of tube 522 as the rollers approach and recede from the point of occlusion. This optimal graduated change in cross-section of the bore of tube 522 helps reduce the peak torque required, puts less stress and wear and tear on tube 522, allows for a more uniform torque demand upon the driving motor 58, which facilitates the use of a smaller motor than would be necessary otherwise, and is physiologically more desirable for the patient whose blood is being pumped.

Since the size of tube 522 can vary slightly and since it is not desirable to fully occlude a tube because the blood cells are crushed, it is important to have precise and accurate means for adjusting the force applied by the rollers, which in turn determines the extent to which a given tube is occluded. FIGS. 3 and 5 show in detail the mechanism which is used to adjust each of the rollers 500 and 502. It should be noted that each roller may be independently adjusted as necessary. This feature is significant because it allows each roller to have independent radial deflection to provide proper occlusion of tube 522 despite irregularities in tube 522.

The roller adjusting mechanism for each roller is radially oriented about axis 508 and includes the following elements. Arms 510 and 512 have support extensions 540 and 542 projecting therefrom respectively. Secured against rotation and extending through each support extension 540 and 542 is a threaded member 544 and 546 respectively onto which are threaded thumb wheels 548 and 550 respectively having knurled outer surfaces to facilitate their rotation. Each of thumb wheels 548 and 550 has an internally threaded neck portion (shown for thumb wheel 548 as 552 in FIG. 5) which is threaded onto threaded members 544 and 546 respectively. Each thumb wheel 548 and 550 is provided with a counterbore in the face of rotator 514 which for thumb wheel 548 is shown in FIG. 5 to be counterbore 554. Corresponding to each of these counterbores is a counterbore in the face of rotator 514 which for thumb wheel 548 is shown in FIG. 5 to be counterbore 556.

Positioned between counterbore 554 and 556 is a compression spring 558 which is shown in partially compressed state. Thumb wheel 550 has a corresponding spring 560. Each thumb wheel 548 and 550 has an elastic sleeve 562 and 564 respectively, located concentrically within respective spring 558 and 560 and which fits around and is supported by the corresponding neck portion which for thumb wheel 548 is neck portion 552. In partially compressed state as shown in FIG. 5, sleeve 562 is longer than neck portion 552 and spring 558 is longer than sleeve 562. The same size relationships exist for springs 560, sleeve 564 and the neck portion of thumb wheel 550.

The operation of the roller adjusting mechanism is as follows and will be described in conjunction with the adjustment of roller 500 with thumb wheel 548. Of course, the adjustment of roller 502 using thumb wheel 550 works in exactly the same manner. Slightly compressed with no tightening of thumb wheel 548, spring 558 is seated at one end in counterbore 554 and at the other end is seated in counterbore 556. The free height of spring 558 and the space in which it is retained is selected so that very little force is applied to roller 500. As thumb wheel 548 is tightened, greater force is exerted on roller 500 by spring 558. As tightening continues sleeve 562 comes in contact with counterbore 556 in rotator 514. As tightening of thumb wheel 548 continues, roller 500 is loaded with the combined effort of spring 558 and sleeve 562 in compression. A final point of maximum pressure is reached when the end of neck portion 552 contacts counterbore 556 in rotator 514. This configuration allows a wide range of spring effort available to occlude tube segments of the softest and the hardest durometers. Also, the rate of change of spring effort is gradual for the first few turns of thumb wheel 548, which allows very fine adjustment necessary to occlude soft durometer tubes. Then the rate of change of spring effort becomes greater to allow quicker occlusion adjustment for harder durometer tubes. The end of neck portion 552 prevents further compression of spring 558 and sleeve 562 when it comes in contact with counterbore 556. This prevents spring 558 and sleeve 562 from taking a permanent set since any spring would take a set if compressed beyond a certain point.

Another feature with which the pump is provided is a button (not shown) on the side of the casing which when depressed moves a rod into a groove notched into shaft 517. When the rod is seated in this groove, the rotator head assembly is prevented from rotating. This facilitates unscrewing of the locking screw 519 seated in rotator 514 which permits the entire rotator head assembly to be removed for maintenance and servicing purposes.

As mentioned in the description of the parent with respect to the control circuitry, the pump is provided with a cover 570 which is shown partially open in FIG. 1 and closed in FIG. 2. Side face 531 is formed intergral with the material out of which surface 520 is made. Top surfaces 572 of side face 531 has a magnetic closure 574 which cooperates with magnetic closure 576 located on the underside of cover 570. Closure 574 is connected to the interlock circuit 53 shown in FIGS. 1 and 4 of the parent patent. When cover 570 is closed magnetic closures 574 and 576 keep the cover in closed position as well as serving as the closed switch 254 in FIG. 4 of the parent patent to allow rotator 514 to be driven by motor 58. When cover 570 is opened, contact is broken between magnetic closures 574 and 576 thereby in effect opening switch 254 of interlock circuite 53 which serves to disable motor 58 and stop further rotation of rotator 514 thereby rendering the pump inoperative. Thus cover 570 and interlock circuit 53 serve as a safety system to stop operation of the pump if cover 570 is opened for any reason.

Although the various features of the invention have been shown with respect to a preferred embodiment of the invention, it will be evident that changes may be made in such details and certain features may be used without departing from the principles of the invention.

We claim:

1. In a pump comprising an arcuate bearing surface adapted to carry a flexible tube through which fluid may pass, a pair of 180° spaced-apart, pivotally-mounted rollers whose axes travel along a circular path concentric with said bearing surface whereby said rollers occlude the tube so as to pump the fluid therethrough, means for rotating said rollers around said circular path, and lead ramps extending from each end of said bearing surface, the improvement wherein:

said bearing surface defines an arc of approximately 168° and each of said lead ramps is substantially tangent to the end of the bearing surface from which said respective lead ramp extends so as to provide the optimal torque peak reduction for driving said pump, and the optimal graduated change in cross-section of the bore of the tube as each of said rollers approach and recede from the points of occlusion of the tube;

and further comprising means located radially with respect to the axis of rotation of said rotating means independently operable with respect to each of said rollers for independently and precisely varying the extent to which each of said rollers occludes the tube, including means for continuously adjusting the radial deflection of each roller as it occludes the tube so as to provide proper occlusion despite tube irregularities while allowing for varying the rate of change of radial force applied to each of said rollers, said means for varying the extent to which each of said rollers occludes the tube comprising two separate arms, each of said arms carrying one of said rollers, said continuously adjusting means comprising a separate thumb wheel threadedly connected to each of said arms, each of said thumb wheels having a neck portion, and compression spring and an elastic sleeve concentrically located around said neck portion, said spring being spaced from said sleeve and said sleeve being located within said spring and supported by said neck portion.

2. A pump as set forth in claim 1 wherein each rotating means and each of said thumb wheels are provided with counterbores for properly seating said respective spring and sleeve.

3. A pump as set forth in claim 2 wherein in uncompressed state each of said springs is greater in length than its corresponding sleeve and in uncompressed state each of said sleeves is greater in length than the corresponding neck portion of said respective thumb wheel.

4. A pump as set forth in claim 3 wherein tightening of a thumb wheel will first begin to compress said respective spring and as tightening continues compression of said sleeve begins whereby the rate of change of force applied to said respective roller increases as said respective thumb wheel is further tightened.

5. A pump as set forth in claim 1 further including means for automatically preventing movement of said means for moving said rollers around said circular path thereby permitting safe servicing of said pump.

6. A pump as set forth in claim 1, further comprising guide means located radially with respect to the axis of rotation of said rotating means for maintaining the tube in proper position with respect to said bearing surface.

* * * * *